United States Patent [19]

Clairmonte

[11] 3,945,531

[45] Mar. 23, 1976

[54] PAY-OUT DEVICES

[75] Inventor: Edward Hugh Clairmonte, New Barnet, England

[73] Assignee: Clairmonte Bros., Limited, London, England

[22] Filed: Dec. 10, 1973

[21] Appl. No.: 423,692

[30] Foreign Application Priority Data

Dec. 11, 1972 United Kingdom ..... 57046/72

[52] U.S. Cl. ..... 222/27; 194/13

[51] Int. Cl.[2] ..... B67D 5/08

[58] Field of Search ..... 222/2, 14–20, 222/23, 27, 39; 194/2, 3, 13

[56] References Cited

UNITED STATES PATENTS

| | | | |
|---|---|---|---|
| 2,585,821 | 2/1952 | Mueller | 222/20 |
| 2,781,949 | 2/1957 | Stoneburner | 222/27 |
| 3,128,910 | 4/1964 | Calhoun | 222/20 |
| 3,138,385 | 6/1964 | Giacobello | 222/27 |
| 3,285,380 | 11/1966 | Sykes | 194/2 |
| 3,468,476 | 9/1969 | Keegan | 194/2 |
| 3,670,924 | 6/1972 | Asper | 222/2 |
| 3,731,777 | 5/1973 | Burke et al. | 194/13 |

*Primary Examiner*—Robert B. Reeves
*Assistant Examiner*—Joseph J. Rolla
*Attorney, Agent, or Firm*—Woodhams, Blanchard and Flynn

[57] ABSTRACT

Apparatus for paying out a bonus or a premium when a machine, such as a petrol pump, has dispensed a predetermined quantity of a commodity. The apparatus comprises a control device in a housing and a pay-out device on the housing. The control device is arranged to generate an output signal to actuate the pay-out device when the machine with which it is associated has dispensed a predetermined quantity of the commodity.

15 Claims, 5 Drawing Figures

PAY-OUT DEVICES

This invention relates to control apparatus for a pay-out device of the kind in which a bonus or premium is paid out occasionally to a person using, or having goods dispensed from a machine with which the device is associated.

Such devices may be associated with vending machines, coin-operated washing-machines and dry-cleaning machines, and to any other machine which dispenses goods and/or services. One application of the invention is to the control of a pay-out device associated with a pump for dispensing petroleum spirit, such as a self-service petrol pump.

According to the invention in one aspect there is provided electrical control apparatus for a pay-out device, comprising means for providing a plurality of pulses in dependence upon the quantity of a commodity dispensed by, or the number of operations of, a machine with which the device is, in operation, associated, a counter for counting pulses from the pulse-generating means and for generating an output signal when the count reaches a predetermined value and means for coupling the output signal to actuate a pay-out device.

The means for providing a plurality of pulses may comprise means for providing a pluraltiy of pulses of light in dependence upon the quantity of commodity dispensed by, or the number of operations of, the machine with which the pay-out device is associated, and means for converting the light pulses to electrical pulses. For example, it may be a fibre-optic light guide arranged to receive pulses of light at one end and a photosensitive device, such as a photo-cell or photo-transistor arranged at the other end to receive the pulses and to convert them to electrical pulses.

In a preferred embodiment for use with a petrol or other fuel pump having say, three rotatable wheels which register and indicate the quantity of petrol dispensed in tens, units and tenths of a gallon respectively, a mirror is attached, for example, to one side of a wheel, preferably the tenths wheel, a first fibre optic light guide is arranged to receive light from a lamp in the pump or elsewhere and direct it onto the wheel so that light is reflected from the mirror once per revolution of the wheel and is received by a second fibre-optic light guide and communicated to the photosensitive device.

In another embodiment a wheel may be formed with an aperture radially spaced from the axis thereof so that when a source of light is directed towards the wheel on one side thereof a light guide arranged on the other side receives a pulse of light through the aperture once per revolution of the wheel.

The means for providing a plurality of pulses may be means for receiving electrical pulses initiated by the periodic action of a switch or in the case of a petrol filling station the counting pulses used to operate a remote registering desk, or from the cash register in a retail store or the like.

The pay-out device may be arranged to pay-out a bonus or premium automatically on receipt of an actuating signal but preferably is manually-operable to effect pay-out only after receipt of the actuating signal.

The output signal may be coupled to actuate an audible or visual indicator or both when the predetermined value is reached.

Means may be provided for resetting the control apparatus when a pay-out has been made.

Preferably the predetermined value is variable.

Means may be provided for resetting the counter to a datum value, such as zero.

The control apparatus may be housed in a closed housing.

In the case of apparatus for use with a petrol pump the housing is preferably sealed to exclude inflammable vapours, moisture and the like. Preferably the housing is suspended above the petrol pump with the pay-out device so mounted in the housing that it is readily accessible to a person at the pump.

Preferably the housing is provided with transluscent panels and illuminated from the inside by lamps, which may be caused to flash to provide a visual, and eye-catching indication that a pay-out is to be made.

The pay-out device may be a device as disclosed in U.S. Pat. No. 3,640,292 modified so that pay-out is effected manually after it has been actuated by an output signal.

The invention will now be described with reference to the accompanying drawings, in which.

In the drawings, like parts are given like references.

Figure 1:
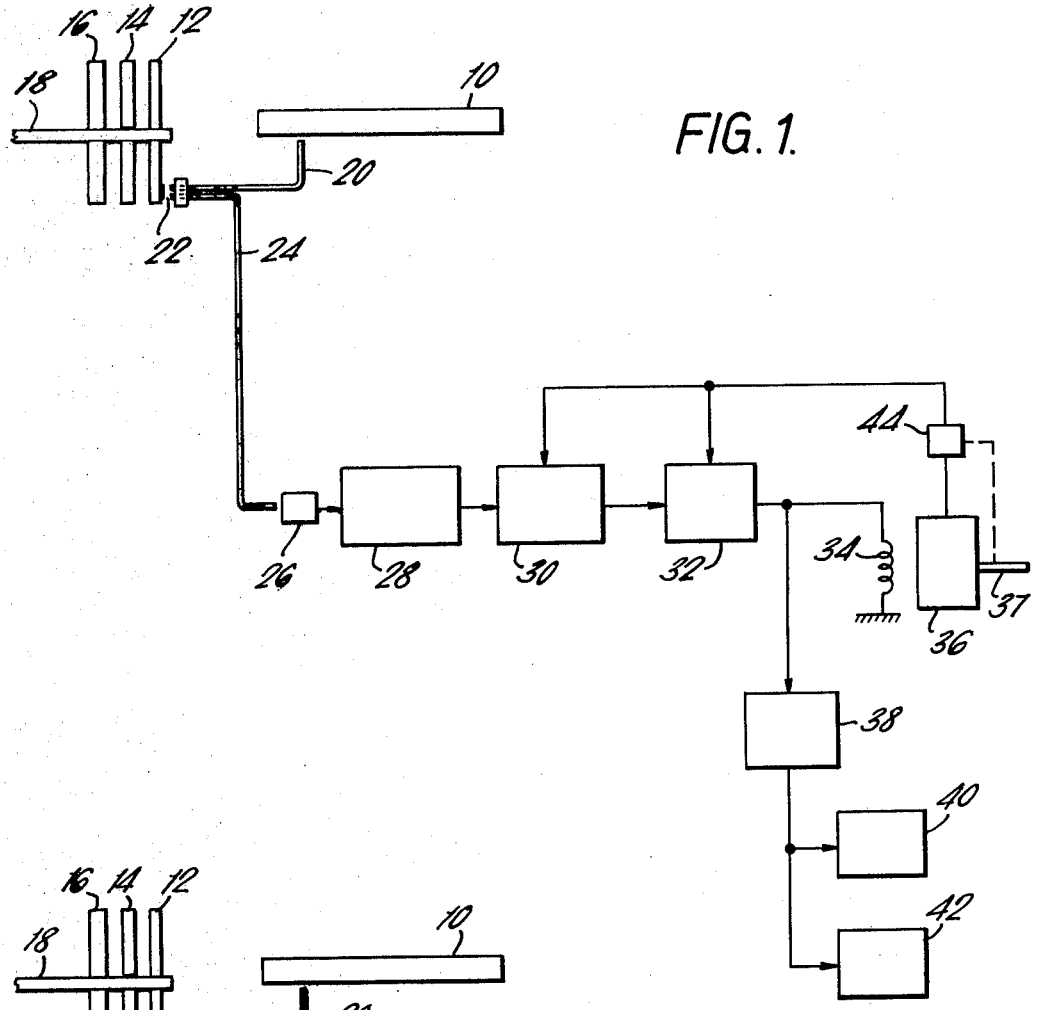
FIG. 1 is a schematic diagram of one embodiment of control apparatus according to the invention.

Referring to FIG. 1, there is shown a schematic diagram of a control apparatus for use with a petrol pump. In the drawing there is shown a fluorescent lamp 10 and wheels 12, 14, 16 rotatably mounted on a shaft 18. The wheels 12, 14, 16 are the convention wheels mounted in a petrol pump (not shown) for indicating in tens, units and tenths of a gallon respectively the quantity of petroleum spirit dispensed by the pump. Likewise the lamp 10 is housed in the pump.

The control apparatus comprises a first fibre-optic light guide 20 arranged to receive light from the lamp 10 and to direct it towards the side of the tenths wheel 12. A mirror 22 is mounted on the side of the wheel 12 as shown so that a pulse of light is reflected back from the mirror once per revolution of the wheel, that is once for each gallon of petrol dispensed. The pulse of reflected light is picked-up by a second fibre-optic light guide 24 and communicated thereby to a photo-sensitive device 26 which converts the light pulse into an electrical pulse. The electrical pulses are coupled through a pulse shaper 28 to a counter 30. The output of the counter 30 is coupled to an output circuit 32 which provides an output signal which is coupled to energise an actuating device 34 of a pay-out device 36 and to means 38 for energising a bell 40 and a lamp 42. The actuating device 34 may be an electromagnet which, when operated, releases a latching device in the pay-out device 36. The pay-out device is arranged to pay-out a premium, of say five coins of suitable denomination, such as five 5 pence coins, when the latching device is released and a manually-operable member 37 is operated. The manually-operable member shown schematically at 37 may be a lever or pull-cord or other suitable member, such as a slide. The pay-out device may be similar to that disclosed in U.S. Pat. No. 3,640,292 modified to make it manually-operable.

The energising means may include a circuit which causes the lamp 42 to flash and the bell 40 to ring to draw attention to the fact that a premium is about to be paid. The lamp 42 may be a fluorescent lamp. The parts 26 to 42 may be housed in a housing 54 (FIGS. 2 and 4 and to be described later) suspended above a petrol pump with which it is associated.

The counter 30 may be set to provide a signal to the output circuit 32 when the pump has delivered a predetermined quantity of petrol, say 20 gallons. Thus each time the pump has delivered 20 gallons of petrol, an output signal will be generated by the circuit 32 to release the pay-out device 36 and to cause operation of the bell 40 and lamp 42 to attract the attention of the customer purchasing petrol from the pump and any other potential or actual customers in the vicinity of the pump. The bell 40 and lamp 42 continue to operate until the customer has operated the pay-out member 37 to receive his premium. Operation of the member 37 automatically actuates a reset device 44 in the form of a magnetically actuated proximity switch. The reset device 44 provides a signal to reset the counter to its datum count, for example, zero and the circuit 32 to stop the bell 40 and the lamp 42.

Figure 2:
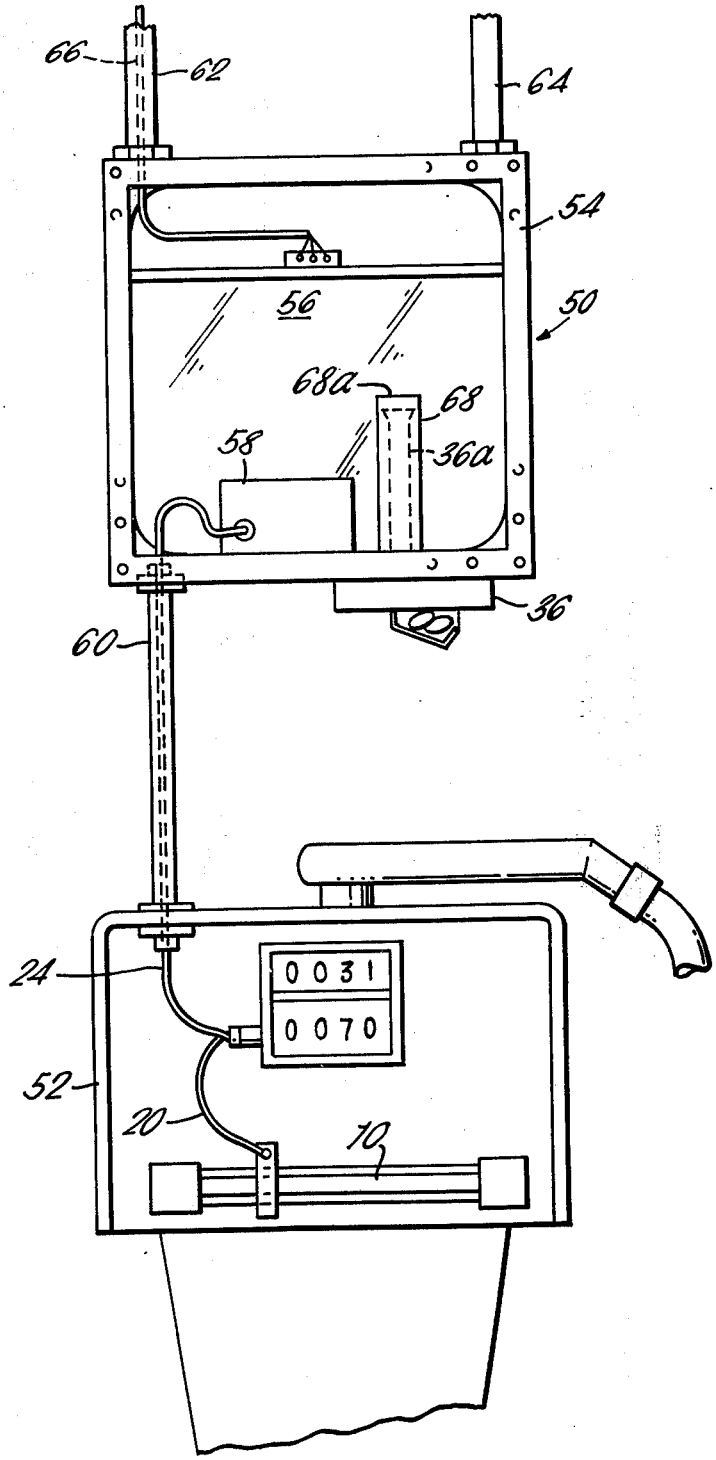
FIG. 2 shows apparatus according to the invention for paying out a bonus or premium for use with a petrol pump.

Referring now to FIG. 2 there is shown apparatus 50 for paying out a bonus or premium when a petrol pump 52 has dispensed a predetermined quantity of petrol, say 20 gallons.

The apparatus 50 comprises a housing 54 in the form of a box suspended above the pump 52. The box has transluscent side panels 56, of which one is shown and is illuminated from within by fluorescent lamps (not shown) controlled by the control apparatus of FIG. 1. The panels may carry advertising literature or other eye-catching material.

A control box 58 mounted in the housing contains control apparatus according to FIG. 1 with the lamp or lamps and bell mounted elsewhere in the housing. The fibre-optic light guide 24 has one end inserted in the control box to illuminate the photo-cell 26 and the other end is lead through a conduit 60 and into the pump 52 where it is arranged to pick up light reflected from a mirror 22 as described with reference to FIG. 1. The other light guide 20 has one end directed to receive light from the fluorescent lamp 10 in the pump 52 and the other end arranged to direct light towards the side of the wheel 12 as described with reference to FIG. 1. It will be seen that there are no electrical connections between the housing 54 and the pump 52.

The housing 54 is suspended above the pump 52 by two metal conduits 62,64 which depend from a canopy which extends over the pumps on the forecourt of a filling station. The mains supply for the electrical apparatus in the housing 54 is supplied by a cable 66 which passes through the conduit 62.

The panels 56 are removeably secured by screws, for example to provide access to the inside of the housing 54 and a rubber gland is provided to make it airtight. This is particularly desirable to exclude inflammable vapours and/or moisture. Likewise, rubber or plastics seals admit entry of the light guide and the electricity supply through the wall of the housing 54.

The pay-out device 36 is detachably secured to the bottom of the housing 54, by means of a bayonet-fixing or other quickly detachable device secured by a lock for example. The unit can thus be removed when the filling station is unattended to prevent theft.

The pay-out unit 36 includes a resevoir **36*a*** for coins or the like, such as described in U.S. Pat. No. 3,640,292.

Figure 3:
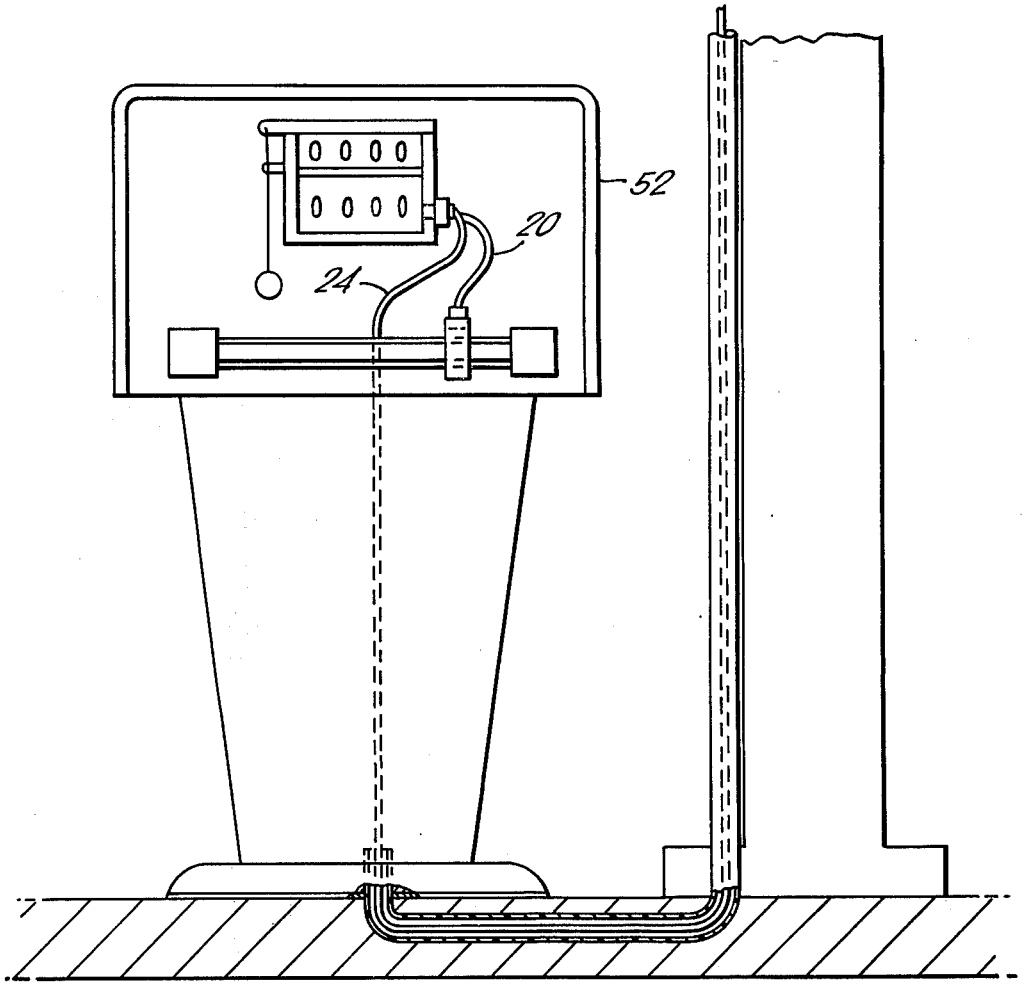
FIG. 3 shows a method of coupling a fibre-optic light guide to receive light pulses generated when the pump is dispensing petroleum spirit.

FIG. 3 illustrates another way of connecting the fibre-optic light guide 24 down through the pump, underground, up one of the stanchions 70 of the canopy and then down to the housing 54.

Figure 4:
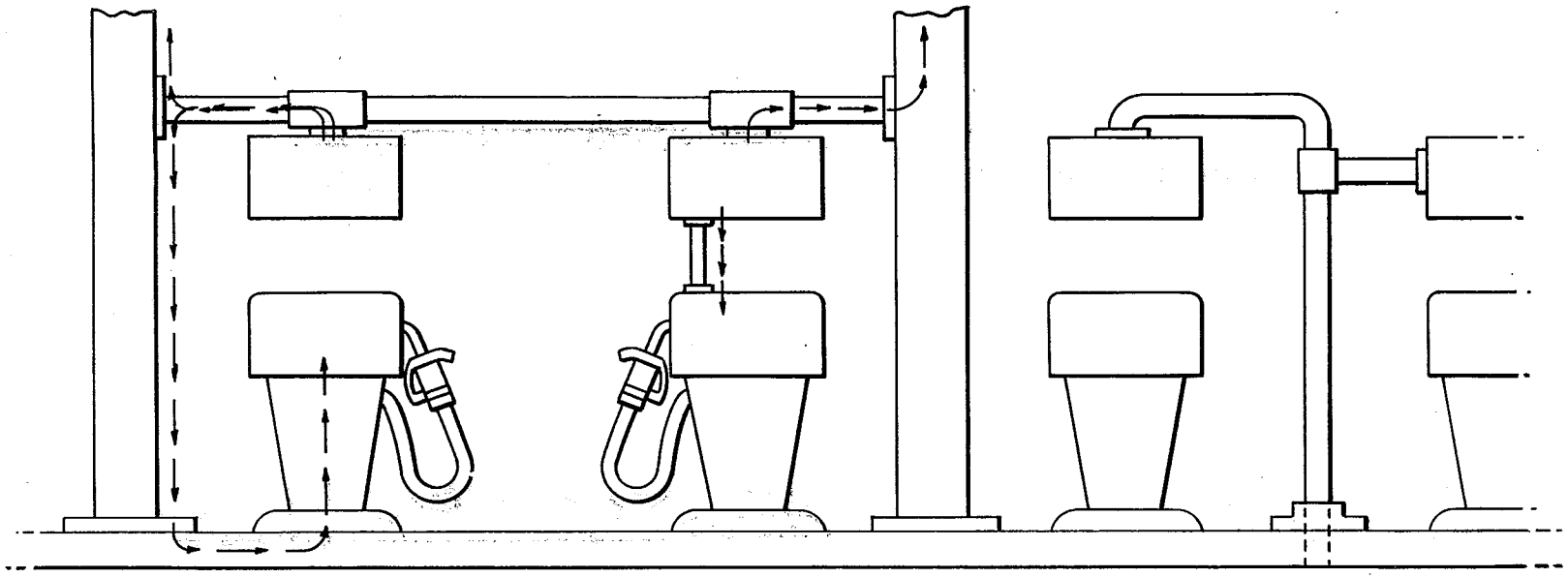
FIG. 4 shows various methods of suspending apparatus according to the invention above a petrol pump.

FIG. 4 shows other methods of suspending the apparatus above the petrol pump.

Because the vertical tube or reservoir **36*a* containing the coins must necessarily penetrate the air-tight case 54, airtightness is maintained by a larger tube 68 with its top end 68*a*** closed off forming part of the case into which the detachable money tube can protrude when the payout unit is in position.

A payout slide or swivelling plate with an orifice immediately below and aligned with the reservoir-tube is in this application locked in position by one or more pawls which prevent its being moved to the pay-out position.

When however the warning devices 40, 42 are actuated to indicate a payout, at the same time an electromagnet situated inside the box 58 and acting through the wall of the case 54 will lift the pawl or pawls and allow the slide to be moved to the payout position.

Physical movement to the payout position may be by a hand-lever or pulling a cord.

When the slide is moved to the payout position it carries with it a magnet (not shown) which when the slide was in the at-rest position had been maintaining a proximity switch (switch 44 in FIG. 1) disposed within the airtight case in the "on" position.

Movement of this magnet causes the switch contacts to break, releasing a relay, thus stopping the chime and flash and releasing the pawl to prevent any further movement of the slide until another payout is due.

An internal safety switch for isolating the device may similarly be operated by movement of a magnet placed outside the case without the need for the case to be pierced.

Thus there has been described:

Apparatus in which all the electrical parts are enclosed within a sealed case, which is actuated at a distance by light pulses received from an area where inflammable vapours may be present and where electrical devices are forbidden unless expensively flame-proofed and approved, which gets its light-source from existing and approved flame-proofed components present for another purpose within that ares, which does not require special licencing to be within or near a prescribed dangerous area, which is actuated by an electronic control box containing solid-state components in which a series of integrated-circuit memory-banks are actuated by a light sensitive cell to count a pre-set number of light pulses before actuating an intermittent flashing and/or other intermittent warning device, in which internal switches are actuated by magnetic fields from outside the case.

Other changes can be made without changing the scope of the invention, for example electromechanical counting devices could be used instead of the electronic counter.

The device may with advantage be provided with a visible digital indicator to show what quantity of the commodity has been dispensed since the last pay-out, or conversely, how many more units need to be purchased in order to obtain pay-out of the bonus or premium.

One reason for including such an indicator is to eliminate any suggestion of chance or lottery which might conceivably be levelled in some applications of the device when it is used in certain States of the world if such indication were not visibly registered.

The indicator is so arranged that it cannot be cancelled or set back to zero, thus assuring that the number of pay-outs made will always be in exact proportion to the quantity of the commodity dispensed.

For example in FIG. 1 the counter 30 could be provided in known manner with a decode and display drive circuit and a digital indicator device for indicating to a user the quantity of a commodity dispensed, the indicator device being so situated in the housing 54 that it can be viewed by the user. In such a case it may be preferable to use a recycling counter and to couple the reset device 44 to de-energise the means 38. The means 38 may be a bistable device set to one state by the output circuit 32 to energise the bell 40 and lamp 42 and to its other state by the reset device 44 to de-energise the bell and lamp.

Figure 5:
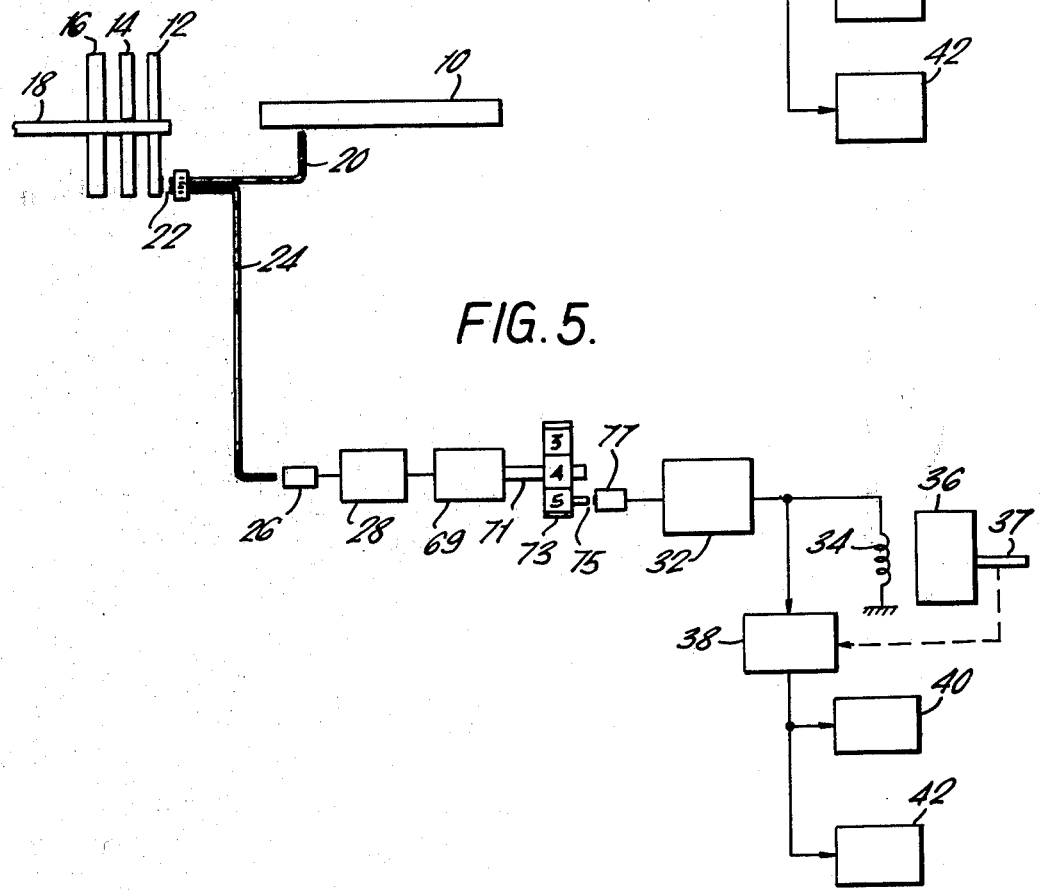
FIG. 5 shows a modified form of the control apparatus of FIG. 1.

In another control apparatus shown in FIG. 5, the electronic counter is replaced by a motor 69 having a shaft 71 arranged to rotate a segmented disc 73 fixedly secured thereto. The disc 73 is provided with digits around its peripheral face and, in use, is so mounted in the housing 54 that the digits can be seen by a user. The motor 69, which may be a stepping motor, is arranged to step or rotate the disc by discrete amounts equivalent to the volume of petrol dispensed. Thus by calibrating the disc 73 in gallons, the user will see at a glance how many gallons have already been dispensed by the pump and how many gallons he has to purchase to gain the bonus. The disc 73 is provided on one side surface near its periphery with an actuating member 75 for actuating a micro-switch 77 for providing a signal to the output circuit 32 for actuating the actuating device 34 and energising means 38 as described above. The reset device 44 is arranged to reset the means 38 as described in the preceding paragraph.

I claim:

1. A bonus or premium dispensing apparatus adapted for use with a machine to permit dispensing of a bonus or premium after preselected operation of said machine, said apparatus comprising:

closed housing means having a plurality of walls defining within said housing means a closed compartment;

a bonus or premium dispensing device attached to one of said walls and disposed exteriorly of said compartment;

pulse generating means adapted for association with said machine for generating a plurality of pulses in dependence upon the operation of the machine;

control means disposed within said closed compartment for counting the pulses generated by said pulse generating means and for actuating the bonus dispensing device upon counting of a predetermined number of pulses which is representative of said preselected operation;

said control means including counting means disposed within said compartment for counting the pulses received from said pulse generating means and for generating an output signal when the count reaches said predetermined number;

said control means further including actuating means disposed within said compartment and responsive to said output signal for actuating the bonus dispensing device to permit dispensing of a bonus or premium, said actuating means and said bonus dispensing device being separated and isolated from one another by one of the walls of said housing means; and indication means operatively connected to said counting means for continuously indicating when the next bonus or premium is to be dispensed, said indication means disposed as to be visible from the exterior of the housing means.

2. An apparatus according to claim 1, wherein said bonus dispensing device is detachably mounted on said housing means exteriorally of said compartment.

3. An apparatus according to claim 1, wherein said bonus dispensing device has manually operable means associated therewith to permit dispensing of the bonus only after said dispensing device is actuated by said actuating means.

4. An apparatus according to claim 3, including reset means for resetting the control means only after a bonus has been dispensed.

5. A bonus or premium dispensing apparatus adapted for use with a machine to permit dispensing of a bonus or premium after preselected operation of said machine, said apparatus comprisng:

closed housing means having a plurality of walls defining within said housing means a closed compartment;

a bonus or premium dispensing device attached to one of said walls and disposed exteriorly of said compartment;

pulse generating means adapted for association with said machine for generating a plurality of pulses in dependence upon the operation of the machine;

control means disposed within said closed compartment for counting the pulses generated by said pulse generating means and for actuating the bonus dispensing device upon counting of a predetermined number of pulses which is representative of said preselected operation;

said control means including counting means disposed within said compartment for counting the pulses received from said pulse generating means and for generating an output signal when the count reaches said predetermined number;

said control means further including actuating means disposed within said compartment and responsive to said output signal for actuating the bonus dispensing device to permit dispensing of a bonus or premium, said actuating means and said bonus dispensing device being separated and isolated from one another by one of the walls of said housing means;

said bonus dispensing device having manually operable means associated therewith to permit dispensing of a bonus or premium only after said dispensing device is actuated by said actuating means; and reset means for resetting the control means only after a bonus or premium has been dispensed, said reset means including magnetically operated switch means disposed within said compartment for resetting said control means and magnet means associated with said dispensing device and responsive to movement of said manually operable means for activating said switch means upon movement of said manually operable means for dispensing a bonus or premium, said switch means and said magnet means being isolated from one another by one of the walls of said housing means.

6. An apparatus according to claim 5, wherein said bonus dispensing device is detachably mounted on one of the walls of said housing means.

7. A bonus or premium dispensing apparatus adapted for use with a machine to permit dispensing of a bonus or premium after preselected operation of said machine, said apparatus comprising:

closed housing means having a plurality of walls defining within said housing means a closed compartment;

a bonus or premium dispensing device attached to one of said walls and disposed exteriorly of said compartment;

pulse generating means adapted for association with said machine for generating a plurality of light pulses in dependence upon the operation of the machine;

control means disposed within said closed compartment for counting the pulses generated by said pulse generating means and for actuating the bonus dispensing device upon counting of a predetermined number of pulses which is representative of said preselected operation;

said control means including counting means disposed within said compartment for counting the pulses received from said pulse generating means and for generating an output signal when the count reaches said predetermined number;

said control means also including converter means disposed within said compartment for converting said light pulses into electrical signals, said converter means supplying said electrical signals to said counting means, and fiber-optic light guide tube means extending between said pulse generating means and said converter means for transmitting the light pulses from said pulse generating means to said converter means; and said control means further including actuating means disposed within said compartment and responsive to said output signal for actuating the bonus dispensing device to permit dispensing of a bonus or premium, said actuating means and said bonus dispensing device being separated and isolated from one another by one of the walls of said housing means.

8. An apparatus according to claim 7, wherein said housing means is disposed remote from said machine, and wherein said light guide tube means comprises the sole operative connection between said pulse generating means which is located at said machine and the control means which is located within said housing means, the interconnection between said housing means and said machine being free of electrical connections.

9. An apparatus according to claim 8, wherein said machine is a fluid dispensing mechanism having a plurality of rotatable wheels which register and provide a digital indication of the quantity of fluid dispensed, and said pulse generating means coacting with one of said rotatable wheels for generating light pulses responsive to the rotation of said one wheel.

10. An apparatus according to claim 9, wherein said pulse generating means includes a light source associated with said fluid dispensing apparatus and a light guide tube extending between said light source and said one wheel for receiving light from said light source and for directing said light onto said one wheel, said one wheel having means thereon adapted to pass by said light tube for generating light pulses, and said light guide tube means having one end thereof disposed in the vicinity of said one wheel for receiving the light pulses created by rotation of said one wheel.

11. An apparatus according to claim 9, wherein said fluid dispensing device comprises a pump having nozzle means associated therewith for dispensing a combustible fluid, said housing means being disposed remote from said pump and being sealed to exclude inflammable vapors and moisture.

12. An apparatus according to claim 11, wherein said housing means is suspended above the pump and has the bonus dispensing device mounted thereon and positioned so as to be readily accessible to a person located in the vicinity of the pump, the pump and the housing means being free of any electrical interconnection therebetween.

13. The combination comprising:

a pump assembly for dispensing a liquid, said pump assembly including a dispensing nozzle and also including indicating means for visually indicating the quantity of liquid dispensed, said indicating means including a plurality of rotatable indicating members which register and provide a visual indication of the quantity of liquid dispensed in volumetric units, and a pulse generating means associated with said pump assembly for generating a plurality of pulses in dependence upon the quantity of liquid dispensed by said pump assembly; and a bonus dispensing apparatus associated with said pump assembly for dispensing a bonus or premium after a predetermined quantity of liquid has been dispensed by said pump assembly, said dispensing device including housing means positioned remote from said pump assembly and defining therein a closed compartment, counting means positioned within said compartment for counting the number of pulses generated by said pulse generating means and for emitting an output signal upon counting a predetermined number of pulses, a bonus dispensing mechanism mounted on said housing means and disposed externally of said housing means, and actuating means disposed within said compartment and associated with said counting means for actuating said bonus dispensing mechanism to permit dispensing of a bonus upon generation of said output signal by said counting means; and connecting means joining said housing means to said pump assembly for transmitting the pulses generated by said pulse generating means to said counting means, said connecting means being free of electrical connections.

14. A combination according to claim 13, further including indicator means associated with said counting means for visually indicating when the next bonus is to be dispensed.

15. A combination according to claim 14, wherein said pulse generating means generates a plurality of light pulses, and said connecting means including a fiber-optic light transmitting tube extending from said pulse generating means into the interior of said compartment defined by said housing means.

* * * * *